United States Patent [19]

Rywak et al.

[11] 4,234,106

[45] Nov. 18, 1980

[54] FUEL DELIVERY SYSTEM FOR A FURNACE OR KILN

[75] Inventors: Donald E. Rywak, New Kensington; James L. Griffith, Pittsburgh; Frederick D. Rhodes, Saxonburg; Otto Kovalsics, Pittsburgh, all of Pa.

[73] Assignee: Pullman Incorporated, Chicago, Ill.

[21] Appl. No.: 965,627

[22] Filed: Dec. 1, 1978

[51] Int. Cl.[3] ..... G01F 11/24

[52] U.S. Cl. ..... 222/239; 222/311; 406/65

[58] Field of Search ..... 222/239, 241, 242, 410, 222/311, 315, 625; 406/65, 68

[56] References Cited

U.S. PATENT DOCUMENTS

| | | | |
|---|---|---|---|
| 722,528 | 3/1903 | Miner et al. | 222/311 X |
| 2,626,729 | 1/1953 | Ajero | 222/242 |
| 2,645,384 | 7/1953 | Juzwiak et al. | 222/311 X |
| 2,652,011 | 9/1953 | Van Ramshorst . | |
| 2,713,428 | 7/1955 | Kuhn et al. . | |
| 2,773,629 | 12/1956 | Miller . | |
| 2,848,143 | 8/1958 | Gandrud | 222/242 |
| 3,033,134 | 5/1962 | Henneike . | |
| 3,865,053 | 2/1975 | Kolze et al. . | |
| 3,878,287 | 4/1975 | Müller et al. . | |

*Primary Examiner*—David A. Scherbel
*Attorney, Agent, or Firm*—Richard J. Myers

[57] ABSTRACT

A series of operatively interconnected fuel flow regulators are adapted to meter and direct the flow of particulate fuel from a fuel conveying system into the burners of a furnace or kiln. Each regulator is fed by a conveying system and includes a feeder housing having a flow metering impeller and feed rotor arrangement. Each housing includes an adjustable fuel orifice communicating with a respective burner.

19 Claims, 11 Drawing Figures

FUEL DELIVERY SYSTEM FOR A FURNACE OR KILN

BACKGROUND OF THE INVENTION

1. Field of the Invention

The present invention pertains to fuel conveying systems and more specifically to particulate fuel delivery systems for furnace burners.

2. Description of the Prior Art

The prior art discloses a variety of fuel conveying systems for feeding fuel to furnace burners. For example, U.S. Pat. No. 2,713,428 discloses a fuel distributing system which operates to reduce arching and flashback in a material storage system, U.S. Pat. No. 2,773,629 discloses a fuel feeding apparatus for regulating the movement of bulky fuel to a furnace, and U.S. Pat. No. 3,033,134 discloses an apparatus for regulating delivery of airborne pulverized fuel to a furnace.

SUMMARY OF THE INVENTION

The present invention pertains to fuel conveying systems and more specifically to particulate fuel delivery systems for furnace or kiln burners.

The invention provides a fuel flow regulator adapted to meter the flow of particulate fuel to one or more burners at a preselected flow rate, and further, for a series of regulators to be operatively interconnected and driven by a common, variable speed drive motor. Each regulator includes a fuel chute opening to a fuel conveying system at one end and a feeder housing enclosing the other end of the chute.

The feeder housings each include one or more fuel orifices accommodating the flow of fuel therethrough into associated burners. Within the feeders, a flow metering impeller and feed rotor arrangement is provided which is driven by the variable speed motor. An impeller and rotor arrangement is positioned and generally aligned above each orifice, thereby providing for drawing particulate fuel from the chute and directing it through a respective orifice into the associated burner.

It should be particularly noted that the size of each orifice is individually adjustable. Thus, an operator can both vary the speed of the drive motor to simultaneously vary the fuel flow rate of all the interconnected regulators as well as select the desired flow of the regulators with respect to each other commensurate with furnace heating requirements.

DESCRIPTION OF THE PREFERRED EMBODIMENT

Figure 1:
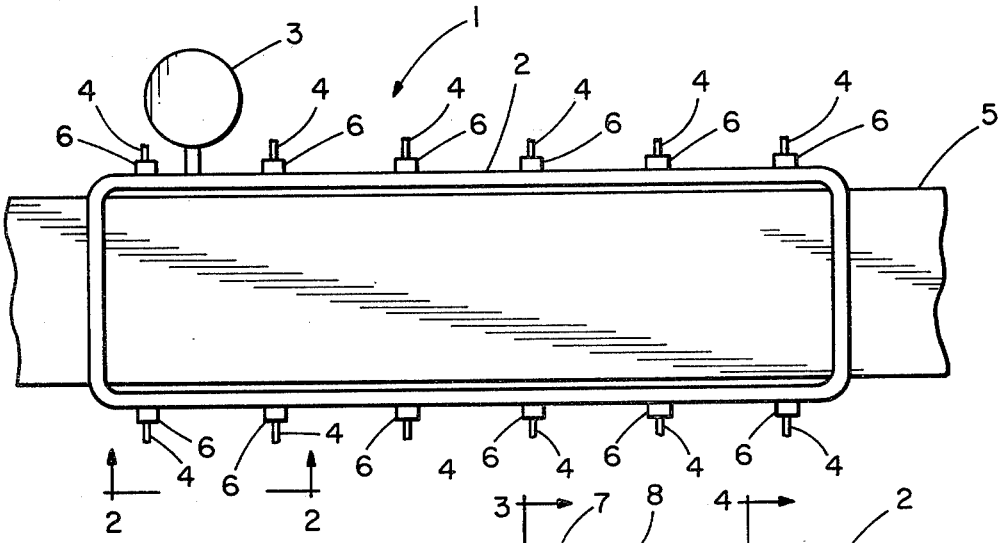
FIG. 1 shows a top plan view of a tunnel kiln embodying the fuel conveying and burner feeder arrangement of the present invention.
Figure 2:
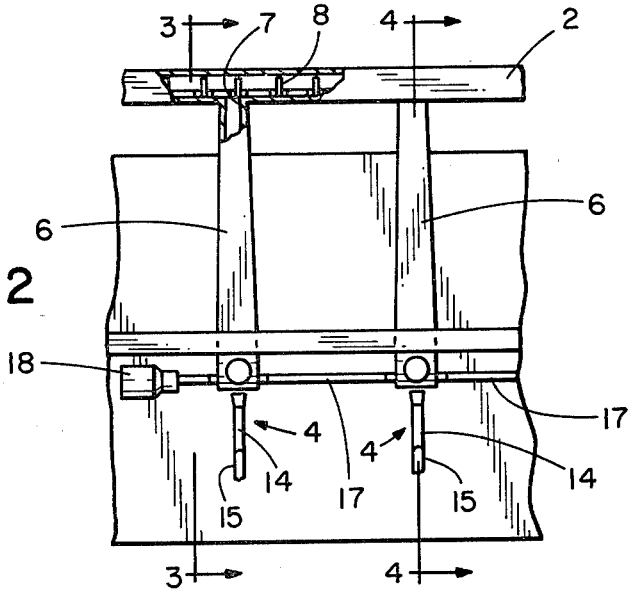
FIG. 2 is a partial side elevational view taken generally along line 2—2 in FIG. 1.
Figure 3:
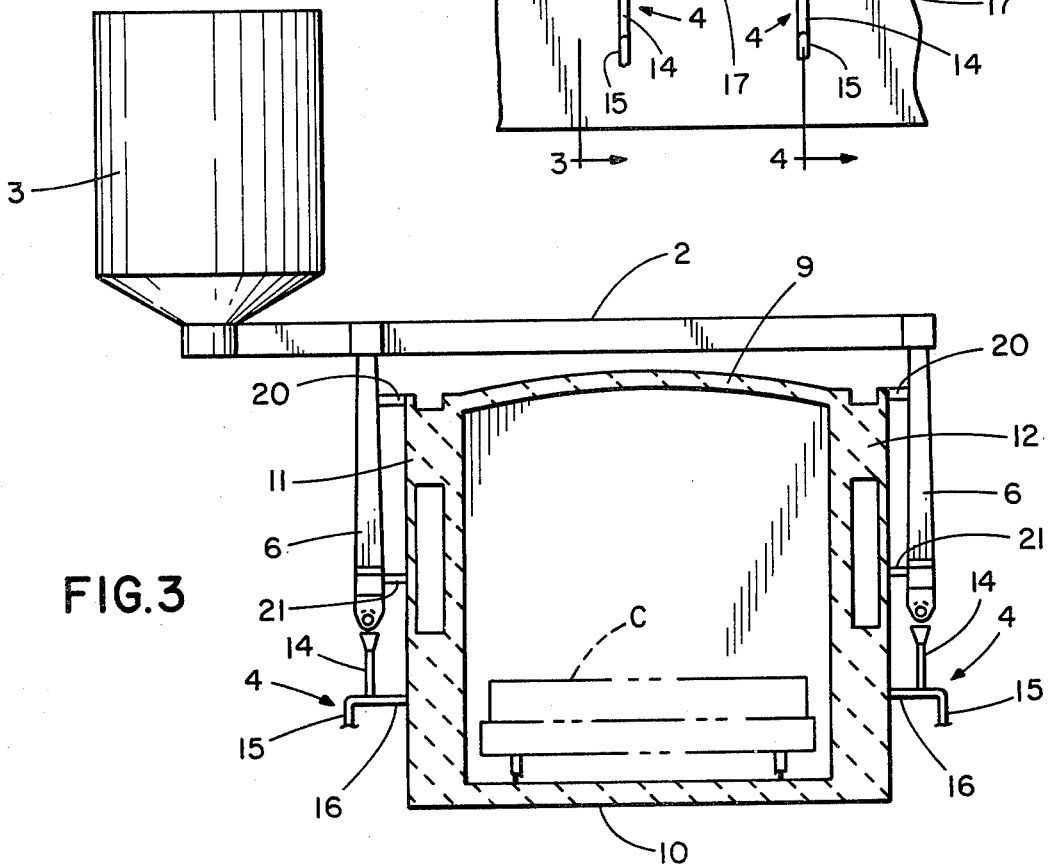
FIG. 3 is a cross-sectional elevational view taken generally along line 3—3 in FIG. 2.
Figure 4:
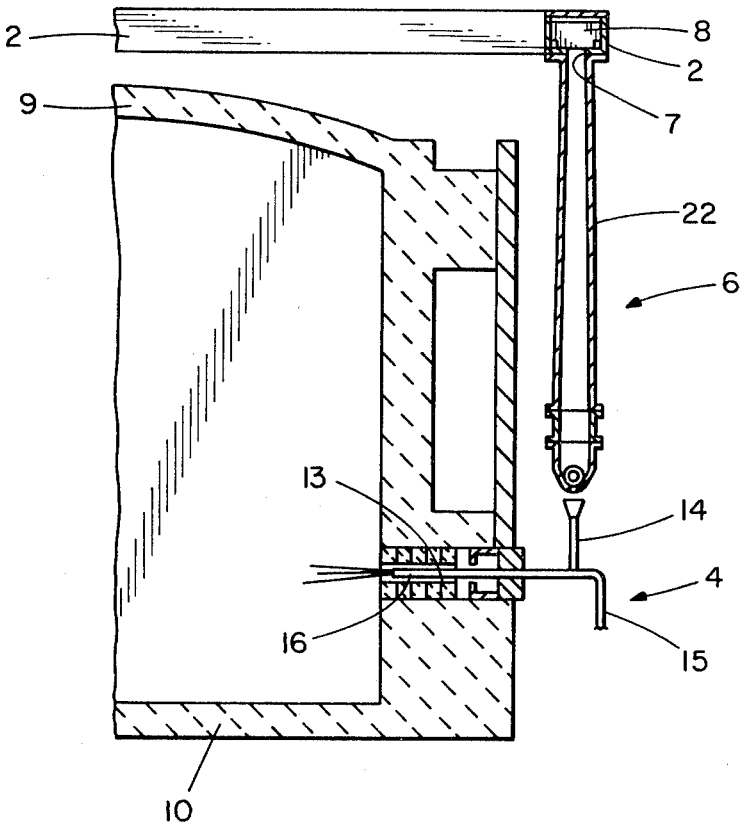
FIG. 4 is an enlarged cross-sectional view partially in section taken generally along line 4—4 in FIG. 2.
Figure 5:
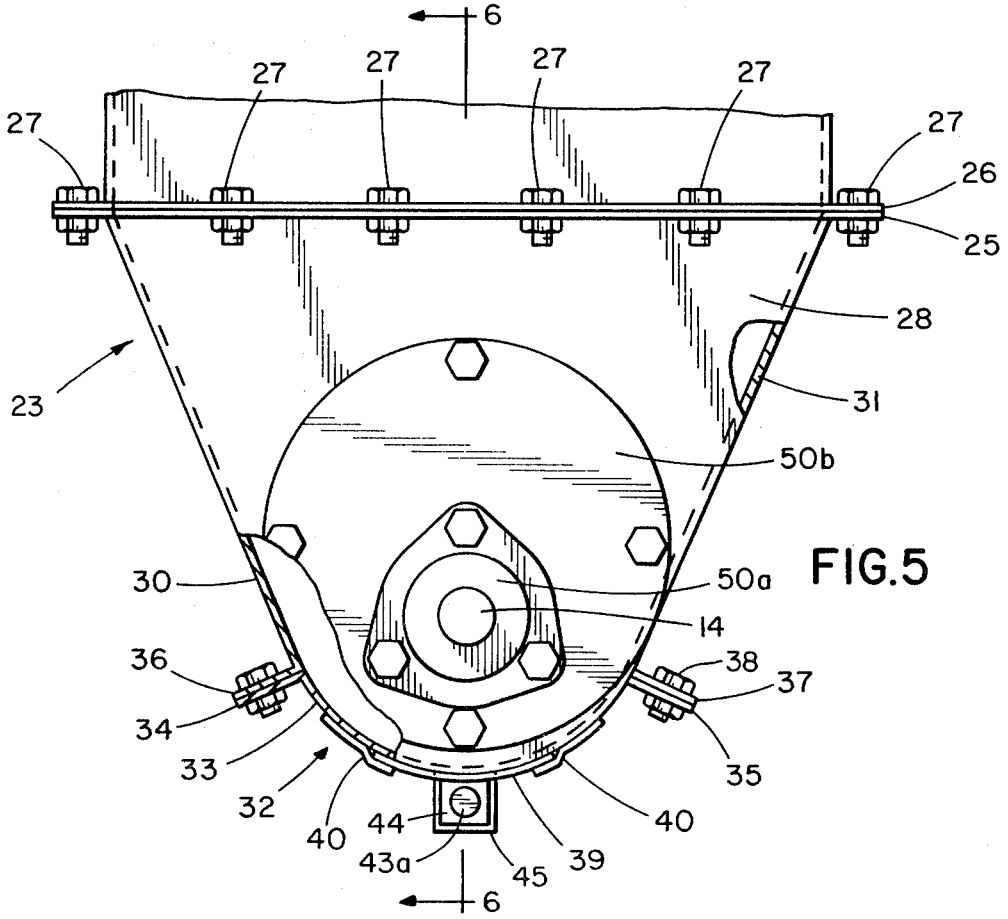
FIG. 5 is an end elevational view of the feeder housing partially in section.

With reference to the drawings, FIG. 1 illustrates the fuel conveying system 1 for which the burner feeding or flow regulating arrangement of the present invention is particularly suited. An endless drag type conveyor 2 fed by a fuel hopper arrangement 3 is supported above a tunnel kiln or furnace 5 through which products to be fired are moved on a conventional carriage arrangement C. The drag conveyor 2 is of a conventional design and is provided with a fuel dumping port 7 above each feeder chute 6 which in turn is adapted to feed fuel into a furnace burner 4 as illustrated in FIGS. 2 and 4. I.e., as the conveyor blades 8 moving particulate fuel along the conveyor pass over each dumping port 7, fuel drops into the chute 6 whereafter it is stored and fed into the respective burner as desired.

The kiln 5 includes top and bottom walls 9, 10 and spaced side walls 11, 12. A plurality of burners 4 are spaced longitudinally along the side walls 11, 12 and extend into the kiln through burner ports 13. It should be noted that depending on the size and heating requirements of the kiln, it may be desired to provide vertically spaced and aligned rows of burners as is well known in the art, said vertically aligned burners being adapted to be fed by a common chute as hereinafter disclosed. The burners 4 are each suited to burn particulate fuel such as woodchips, sawdust, ground refuse or coal or the like which is fed into a feed tube or plenum 14 in each burner 4 which directs the fuel into an air or gas stream from a burner air injection tube 15 in the burner nozzle 16 for injection into the kiln as in the nozzle arrangement disclosed in U.S. Pat. No. 2,652,011 or related gravity fed furnace nozzle designs.

As noted above, the present invention essentially assures uniform preselected fuel flow from the conveyor into the burners, and further, provides for varying the rate of fuel flowing into one burner relative to the others, thereby providing means for varying the heat generated by each burner while accommodating the use of a relatively easily maintained common feeder drive system. Specifically, in the preferred embodiment the feeder chutes 6 mounted on each side wall are operatively interconnected by a series of rotary shafts 17 rotatably driven by a variable speed electric motor 18 mounted on the respective side wall, thereby driving the rotary feeder mechanisms 19 in concert to direct and meter the flow of fuel into the burner as hereinafter described.

Figure 6:
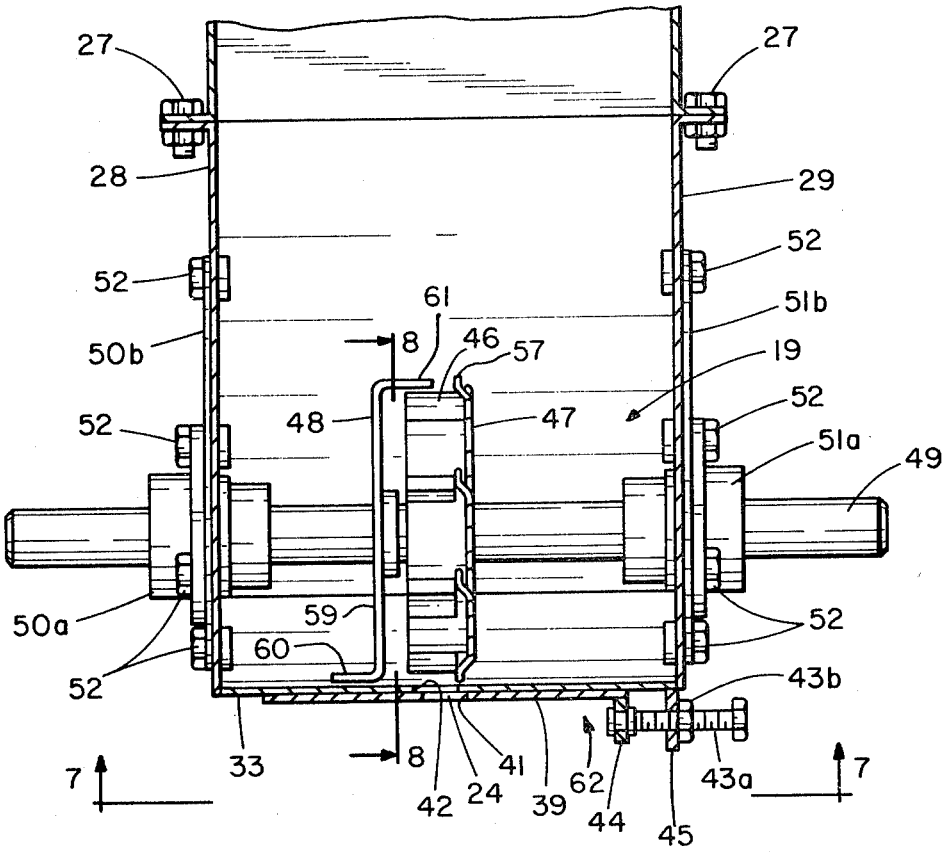
FIG. 6 is a vertical cross-sectional view of the feeder housing taken generally along line 6—6 in FIG. 5.
Figure 7:
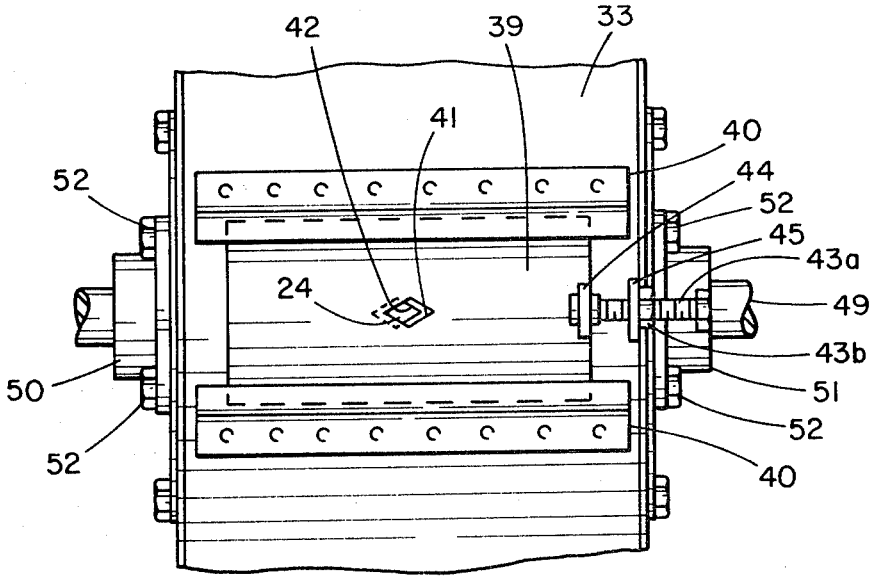
FIG. 7 is a bottom view of the feeder housing taken generally along line 7—7 in FIG. 6.
Figure 8:
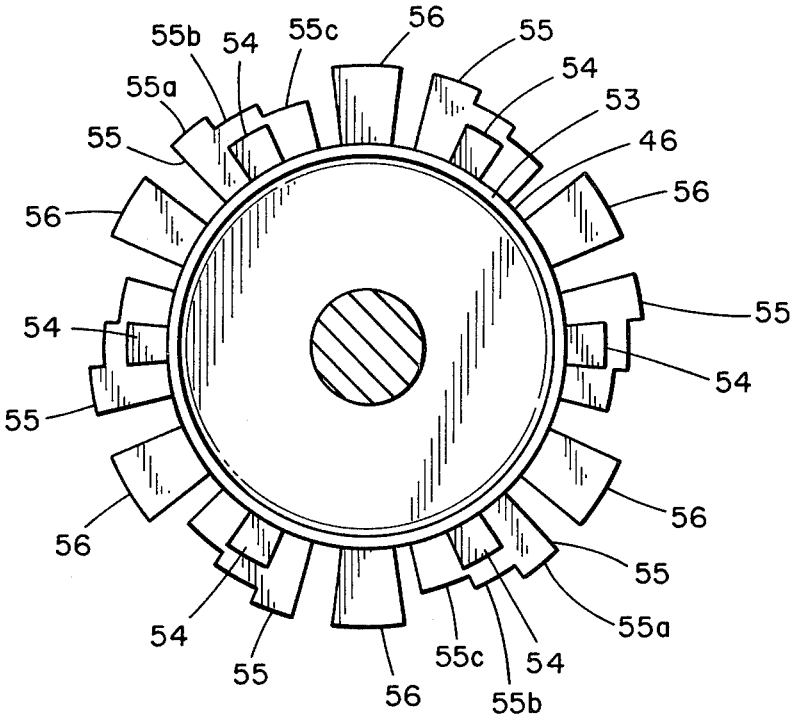
FIG. 8 is an end cross-sectional view taken generally along line 8—8 in FIG. 6.
Figure 9:
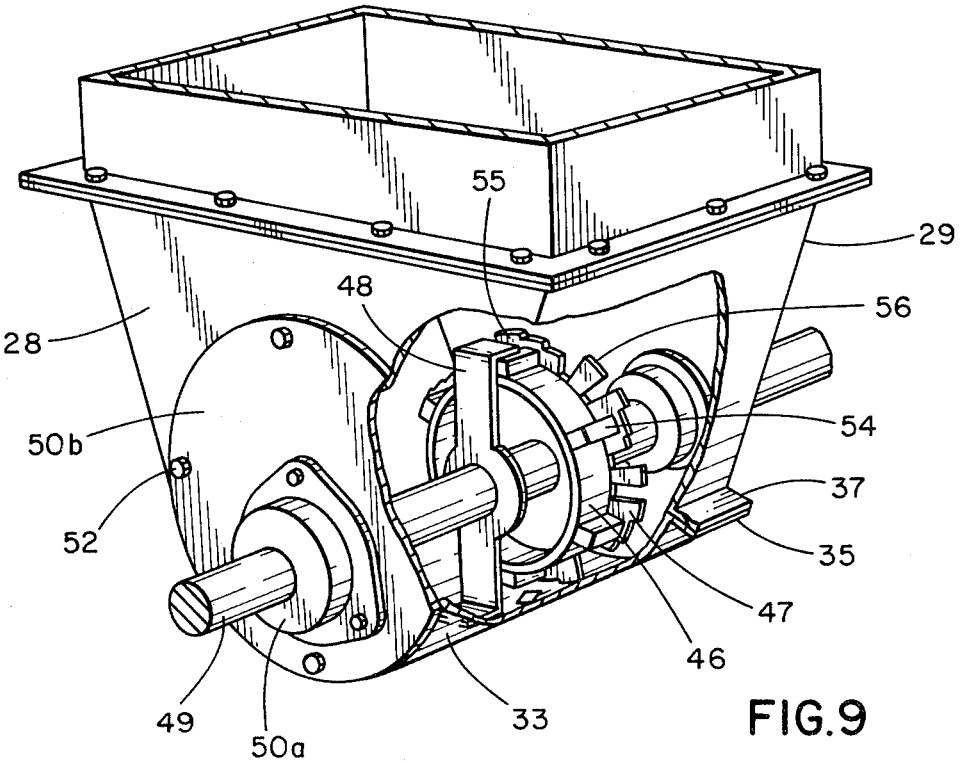
FIG. 9 is a perspective view, partially in section, of the interior of the feeder housing.

The structure of each feeder chute 6 is of a generally rectangular tubular configuration and is supported on a respective side wall 11, 12 by chute support brackets 20, 21, as shown in the drawings. The chute 6 includes an upper substantially vertical reservoir or fuel gathering tube 22 having an upper opening vertically aligned beneath a respective fuel dumping port 7 in the conveyor 2 to accommodate flow into and collection of fuel in the reservoir 22. The lower end of the reservoir is enclosed by a fuel feeder housing 23 of a trough-like configuration and includes an adjustable fuel orifice 24 vertically aligned above and in registry with the respective burner feed tube or plenum 14 to regulate the flow of fuel into the burner. The housing 23 depends from the reservoir and includes upper flanges 25 mating with flanges 26 extending from the lower end of the reservoir tube 22 and removably secured thereto by nut and bolt connections 27. The walls of the housing are defined by laterally spaced end walls 28, 29 and downwardly convergent side walls 30, 31 extending therebetween and are enclosed at their lower ends by a bottom cover plate assembly 32. As shown in the drawings, the cover plate assembly 32 includes a curved bottom plate 33 extending between and adjacently contiguous with the lower edge of the end walls 28, 29 and including flanges 34, 35 removably secured to flanges 36, 37 extending from the lower edge portions of the side walls 30, 31 by nut and bolt fasteners 38. A movable plate 39 is slidably secured to the bottom plate 33 by a pair of slide brackets 40 tack welded to the bottom plate 33 and includes a diamond shaped aperture 41 selectively in registry with a corresponding diamond shaped aperture 42 in the bottom plate 33 to vary the size of the orifice 24, and thus the flow of fuel into the burner. Additionally, and as shown in FIGS. 6 and 7, an orifice adjusting mechanism 62 is provided to shift the movable plate 39 to vary the size of the orifice 24 and secure the plate 39 in position during operation of the feeder. The adjusting mechanism includes a bolt 43*a* pivotally secured to a bracket 44 depending from the movable plate 39 and threadably connected to the bracket 45 by the nut 43*b* welded to the bracket 45 depending from the bottom plate 33. Thus, by twisting the bolt 43*a* an operator can move the plate 39 so as to adjust and secure the apertures in the plates 33, 39 in preselected registry as desired.

As noted above, the rotary feeder mechanism 19 mounted in each feeder housing 23 provides for metering and directing the flow of particulate fuel through the orifice 24. In a preferred embodiment, the mechanism is of a welded construction and includes a flow metering impeller 46, metering disc 47 and feed rotor 48 carried on a drive shaft 49 extending through the housing 23 as shown in the drawings. The drive shaft 49 is rotatably supported by the shaft bearings 50*a*, 51*a* removably secured to the end bearing plates 50*b*, 51*b* in turn secured to the end walls 28, 29 by machine screws 52. The flow metering impeller 46 includes a cylindrical hub 53 and a plurality of circumferentially spaced metering blocks 54 secured to and radially extending from the hub and substantially spanning the orifice 24. The disc 47 is mounted axially adjacent the hub 53, and is fixedly secured thereto. The disc 47 includes a plurality of radially extending vane members 55 having stepped outer edge portions 55*a*, 55*b*, 55*c* and blade members 56, each vane member 55 being adjacent a respective metering block 54 and each blade member 56 having an outer end portion 57 axially offset or radially canted from the vane members 55. The feed rotor 48 is of a Z-shaped configuration and includes a central support 59 mounted on the drive shaft 49 and feed blades 60, 61 laterally extending from opposite sides of the support, the blade 61 radially outwardly overlying the hub 53 and the blade 60 projecting axially away from it.

It should be particularly noted that the hub 53, blocks 54 and the stepped vane members 55 define a plurality of fuel metering chambers about the periphery of the impeller 46 which essentially span the breadth of the fuel orifice. Thus, during feeder operations, the blades 60, 61 and the radially canted blade members 56 draw and direct particulate fuel into each chamber as it moves toward the orifice with the rotation of the impeller, thereby positioning a metered or predetermined quantity of fuel above the orifice which is in turn flung through the orifice by the centrifugal force imparted to it by the rotary motion of the impeller. Additionally, since the stepped outer edge portions 55*a*, 55*b*, 55*c* restrict or limit the lateral flow of fuel within the feeder in the proximity of the orifice 24 in proportion to the size of each step and the fuel particles, the stabilized or controlled discharge of fuel from the feeder is further enhanced and assured.

Figure 10:
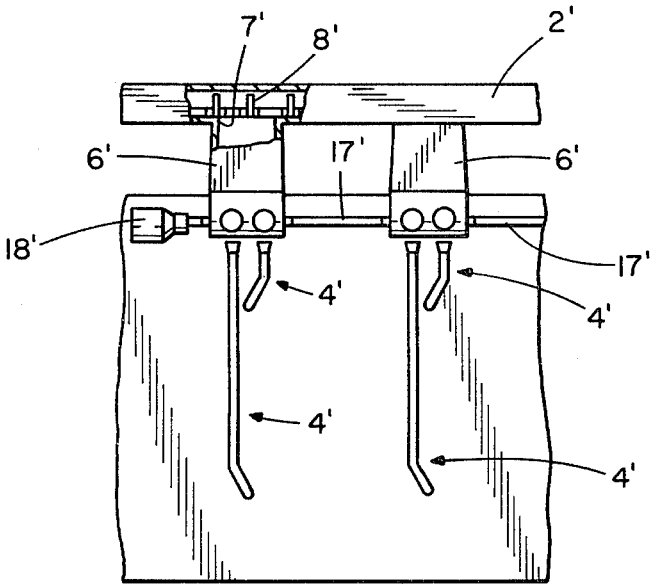
FIG. 10 is a partial side elevational view similar to FIG. 2 showing a modified embodiment of the burner feeder arrangement.
Figure 11:
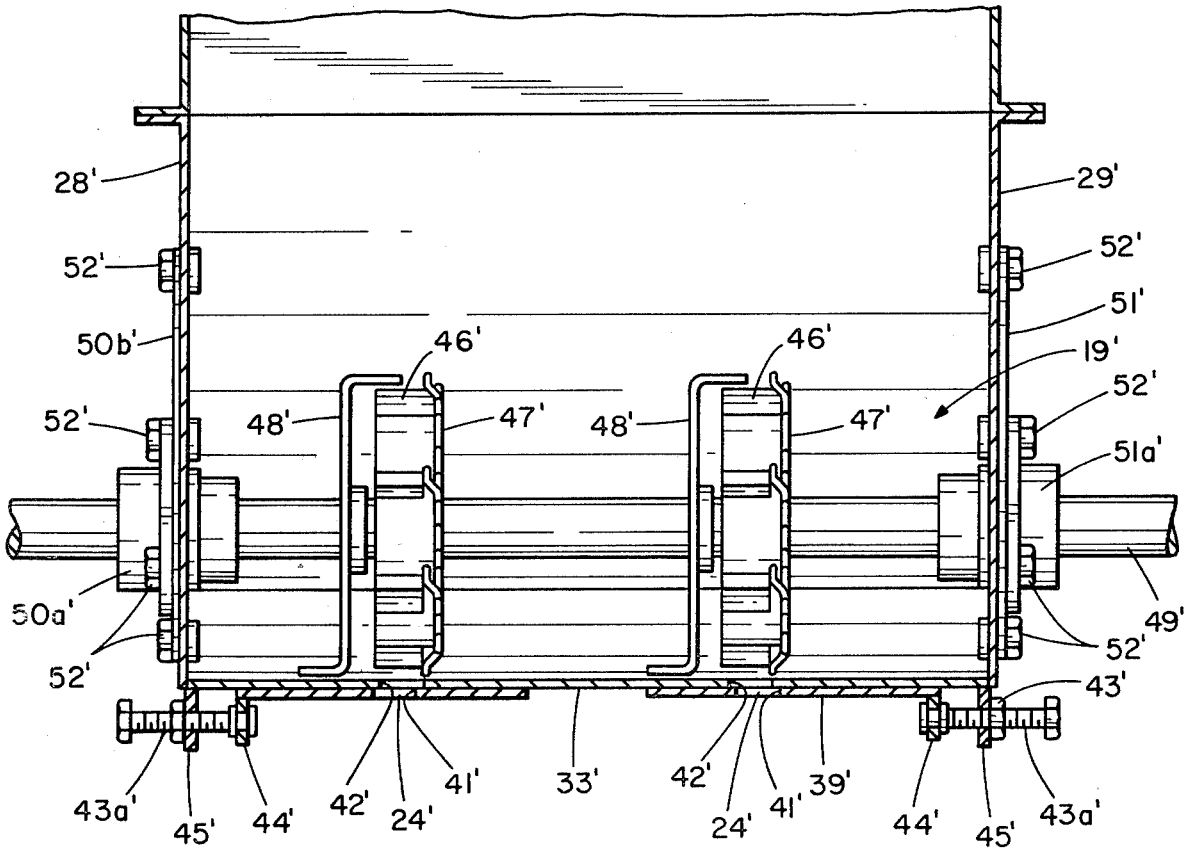
FIG. 11 is a vertical cross-sectional view of the modified feeder housing shown in FIG. 10 taken generally as in FIG. 6.

In the event it is desired to feed fuel into two or more burners from the same chute as illustrated by the modified embodiment shown in FIGS. 10 and 11 (wherein elements similar to those of the foregoing description are designated by prime numbers), a pair of adjustable flow orifices 24' are provided in the feeding housing 23', each feeding into an associated burner feed tube 14' and having a separate metering impeller 46', metering disc 47', and feed rotor 48' vertically aligned above each orifice 24' as in the feeder mechanism 19 disclosed above. This arrangement is particularly suited for tunnel kilns which because of their size and heating requirements, include upper and lower banks of burners 4' which similarly must be closely controlled.

OPERATION

During furnace or kiln firing operations, particulate fuel is supplied by the drag conveyor 2 to each feeder chute 6 and in turn drawn toward and directed into the respective burners 4 by the rotary feeder mechanisms 19. As noted above in regard to the preferred embodiment the feeder mechanisms 19 on each side wall 11, 12 are operatively interconnected by rotary shafts 17 driven in concert by an electric motor 18. Thus, by selectively varying the speed of the motor, the fuel flow rate to the entire kiln may be adjusted according to temperature requirements of the kiln and the combustion characteristics of the particular fuel being used. Furthermore, since the size of each orifice 24 may be varied, the fuel flow and thus the heat input of each individual burner may be adjusted as desired. This is particularly important in tunnel kiln operations where it is necessary to have closely controlled temperature zones along the length of the kiln to insure proper firing of the product being moved through the kiln.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a fuel conveying system providing delivery of particulate fuel to the burners of a furnace a fuel flow regulator adapted to meter the flow of fuel to at least one burner at a preselected flow rate, comprising:

a chute including a fuel reservoir portion opening to said fuel conveying system at one end of said chute and having a fuel feeder housing enclosing the other end of said chute, said feeder housing having an orifice therethrough accommodating flow of fuel from the reservoir into the burner, drive shaft means extending into said feeder housing and being supported thereby, flow metering means carried by said drive shaft means within the housing and including portions radially extending from said drive shaft means defining fuel metering chambers generally aligned above the breadth of said orifice, said flow metering means further including a plurality of radially extending blade members extending from said drive shaft means adjacent said fuel metering chambers, feed rotor means mounted on said drive shaft means within said housing, and, said feed rotor means and said blade members being operatively reactive upon rotation of said drive shaft means to direct particulate fuel towards said metering chambers in said housing and through the orifice into the burner at a preselected rate of fuel commensurate with burner heating requirements.

2. The invention in accordance with claim 1, and means on said feeder housing for selectively varying the size of said orifice.

3. The invention in accordance with claim 1, and said flow metering means including an impeller mounted on said drive shaft means having a cylindrical hub and a plurality of circumferentially spaced metering blocks radially extending from said hub and substantially spanning the breadth of said orifice.

4. The invention in accordance with claim 3, and said feed rotor means including a central support portion mounted on said drive shaft means, feed blades laterally extending from said central support portion and, one of said feed blades radially outwardly overlying said cylindrical hub.

5. The invention in accordance with claim 1, and said flow metering means including a cylindrical hub portion mounted on said drive shaft means, a plurality of circumferentially spaced metering blocks radially extending from said hub, and a metering disc axially adjacent said hub and metering blocks, thereby providing a plurality of particulate fuel metering chambers about the circumference of said hub replenishable by said feed rotor means to essentially assure uniform preselected fuel flow during burner operations.

6. The invention in accordance with claim 5, and said metering disc having a plurality of radially extending vane members spaced about the circumference of said disc and each of said vanes having radially outwardly stepped outer edge portions.

7. The invention in accordance with claim 6, and said metering disc having a plurality of radially extending blade members, said blade members being spaced about the periphery of said disc, and each of said blade members being disposed between a respective pair of vane members and including radially outer end portions axially offset from said vane members.

8. The invention in accordance with claim 1, and said chute being of a generally tubular construction and said feeder housing being of a generally troughlike configuration including laterally spaced end walls and downwardly convergent side walls extending therebetween and a bottom cover plate extending between and connected with said walls to enclose said housing and said orifice being in said bottom cover plate.

9. The invention according to claim 8, and said bottom cover plate having a plurality of orifices therethrough, and flow metering means and feed rotor means being provided for each of said orifices.

10. The invention in accordance with claim 8, and said bottom cover plate being removably secured to said side walls.

11. The invention in accordance with claim 8, and said bottom cover plate having a first aperture therethrough, and a movable plate and means slidably securing said plate to said bottom plate, and said movable plate including a second aperture therethrough selectively in registry with said first aperture to vary the size of said orifice upon selective movement of said plate.

12. The invention in accordance with claim 11, and said first and second apertures each being of a diamond shaped configuration.

13. The invention in accordance with claim 1, wherein, said blade members include outer end portions axially offset from a plane perpendicular with drive shaft means.

14. For a fuel conveying system providing delivery of fuel to the burners of a furnace, a fuel feeding system adapted to meter the flow of fuel to a plurality of burners, comprising:

a plurality of fuel chutes, each including a fuel gathering portion opening to said fuel conveying system at one end of said chute and having a fuel feeder housing enclosing the other end of said chute and including at least one orifice therethrough accommodating flow of fuel from the chute into one or more associated burners, drive shaft means for each of said housings extending into and being rotatively supported thereby, motor drive means operatively connected with each of said drive shaft means for in-concert driven rotation thereof, flow metering means carried by said drive shaft means within each housing and including portions radially extending from said drive shaft means defining fuel metering chambers, and feed rotor means mounted on said drive shaft means within each housing and being operatively reactive therewith upon rotation of said drive shaft means to draw particulate fuel from the gathering portion and direct it through the orifice into the respective burner at a preselected rate of fuel flow commensurate with burner heating requirements.

15. The invention in accordance with claim 14, and said motor drive means including a rigid rotary shaft extending between and operatively interconnecting the respective drive shaft means of adjacent feeder housings.

16. The invention in accordance with claim 14, and said motor drive means including a variable speed rotary drive motor, whereby the flow of particulate fuel into the burners is selectively increased and decreased in proportion to the speed of the motor.

17. For a fuel conveying system providing delivery of particulate fuel to the burners of a furnace, a fuel flow regulator adapted to meter the flow of fuel to at least one burner at a preselected flow rate, comprising;

a chute including a fuel reservoir portion opening to said fuel conveying system at one end of said chute and having a fuel feeder housing enclosing the other end of said chute, said feeder housing having an orifice therethrough accommodating flow of fuel from the reservoir into the burner, drive shaft means extending into said feeder housing and being supported thereby, flow metering means carried by said drive shaft means within the housing and including portions radially extending from said drive shaft means and being generally aligned above the breadth of said orifice, said flow metering means including an impeller mounted on said drive shaft means having a cylindrical hub and a plurality of circumferentially spaced metering blocks radially extending from said hub and substantially spanning the breadth of said orifice, feed rotor means mounted on said drive shaft means within said housing substantially adjacent said metering means and being operatively reactive therewith upon rotation of said drive shaft means to direct particulate fuel in said housing through the orifice into the burner at a preselected rate of fuel flow commensurate with burner heating requirements, said feed rotor means including a central support portion mounted on said drive shaft means, feed blades laterally extending from said central support portion and, one of said feed blades radially outwardly overlying said cylindrical hub.

18. For a fuel conveying system providing delivery of particulate fuel to the burners of a furnace, a fuel flow regulator adapted to meter the flow of fuel to at least one burner at a preselected flow rate, comprising:

a chute including a fuel reservoir portion opening to said fuel conveying system at one end of said chute and having a fuel feeder housing enclosing the other end of said chute, said feeder housing having an orifice therethrough accommodating flow of fuel from the reservoir into the burner, drive shaft means extending into said feeder housing and being supported thereby, flow metering means carried by said drive shaft means within the housing and including portions radially extending from said drive shaft means and being generally aligned above the breadth of said orifice, said flow metering means including a cylindrical hub portion mounted on said drive shaft means, a plurality of circumferentially spaced metering blocks radially extending from said hub, and a metering disc axially adjacent said hub and metering blocks, thereby providing a plurality of particulate fuel metering chambers about the circumference of said hub replenishable by said feed rotor means to essentially assure uniform preselected fuel flow during burner operations, and said metering disc having a plurality of radially extending vane members spaced about the circumference of said disc and each of said vanes having radially outwardly stepped outer edge portions, feed rotor means mounted on said drive shaft means within said housing substantially adjacent said metering means and being operatively reactive therewith upon rotation of said drive shaft means to direct particulate fuel in said housing through the orifice into the burner at a preselected rate of fuel flow commensurate with burner heating requirements.

19. For a fuel conveying system providing delivery of fuel to the burners of a furnace, a fuel feeding system adapted to meter the flow of fuel to a plurality of burners, comprising:

a plurality of fuel chutes, each including a fuel gathering portion opening to said fuel conveying system at one end of said chute and having a fuel feeder housing enclosing the other end of said chute and including at least one orifice therethrough accommodating flow of fuel from the chute into one or more associated burners, drive shaft means for each of said housings extending into and being rotatively supported thereby, motor drive means operatively connected with each of said drive shaft means for in-concert driven rotation thereof, said motor drive means including a rigid rotary shaft extending between and operatively interconnecting the respective drive shaft means of adjacent feeder housings, flow metering means carried by said drive shaft means within each housing and including portions radially extending from said drive shaft means, and feed rotor means mounted on said drive shaft means within each housing and being operatively reactive therewith upon rotation of said drive shaft means to draw particulate fuel from the gathering portion and direct it through the orifice into the respective burner at a preselected rate of fuel flow commensurate with burner heating requirements.

* * * * *